United States Patent [19]

Benzaria

[11] 3,955,913

[45] May 11, 1976

[54] SELF-CONTAINED GAS TORCH

[76] Inventor: Clement Benzaria, 1, Rue de Clieu, 76200 Dieppe, France

[22] Filed: Oct. 29, 1974

[21] Appl. No.: 518,901

[30] Foreign Application Priority Data

Oct. 29, 1973 France ..... 73.38543
May 7, 1974 France ..... 74.15748

[52] U.S. Cl. ..... 431/344; 431/142; 431/277

[51] Int. Cl.[2] ..... F23D 13/04

[58] Field of Search ..... 222/3, 382, 394, 464; 431/130, 131, 142, 143, 150, 254, 277, 344

[56] References Cited

UNITED STATES PATENTS

| | | | |
|---|---|---|---|
| 3,183,687 | 5/1965 | Quercia | 431/142 |
| 3,196,924 | 7/1965 | Kaminga | 431/344 |
| 3,393,672 | 7/1968 | Costopoulos | 431/344 |
| 3,512,912 | 5/1970 | Linch | 431/344 |
| 3,594,108 | 7/1971 | Villarreal-Cueva | 431/277 |

FOREIGN PATENTS OR APPLICATIONS

| | | | |
|---|---|---|---|
| 592,264 | 11/1940 | United Kingdom | 431/142 |

*Primary Examiner*—Kenneth W. Sprague
*Attorney, Agent, or Firm*—Brisebois & Kruger

[57] ABSTRACT

A self-contained gas torch designed to be held in the hand like a pencil for carrying out precision work.

A gas fired hand-torch of the type comprising a gas reservoir and a burner fitted with an air intake adjustment and a gas intake adjustment, in which a gas inlet tube opens at its free end substantially at the center of the internal volume of the gas reservoir designed to be completely filled with a quantity of liquid gas slightly smaller in volume than half the internal volume of the reservoir.

7 Claims, 3 Drawing Figures

SELF-CONTAINED GAS TORCH

This invention relates to a new self-contained gas torch designed to be held in the hand like a pencil for carrying out precision work.

The torch according to the invention is a useful tool for carrying out small precision welds on workpieces of small dimensions, for smoothing waxes by treatment with flame and for various other do-it-yourself jobs, etc.

Torches of this kind are already known. Although substantially elongated in shape, conventional torches of this type are fairly bulky. At one of the two ends of these known torches there is a burner and at the other end an interchangeable gas reservoir.

The burner comprises a gas injector, followed by a device for introducing additional air and, finally, a nozzle at the outlet end of which the flame of the torch is ignited. Naturally this flame is made up of an inner flame and an outer flame surrounding the inner flame. To obtain inner and outer flames of small dimensions, it is necessary to provide an injector with a narrow opening.

The reduced possibilities of conventional self-contained hand torches arise out of the narrow opening of the injector which restricts the passage of gas in liquid form, especially in the initial phase of application.

In order to obtain the low rate of flow of gas issuing at high speed from a narrow-opening injector required for the satisfactory operation of a small torch, it is not possible to resort to an assembly of felts arranged in a tube to bring the gas to the inlet end of the injector in gaseous form, as is the case with gas lighters.

The injector of the self-contained gas torch according to the invention is essentially supplied with gas in vapour form, by virtue of which it is possible to use very narrow injector openings.

To this end, the self-contained gas torch according to the invention comprises a gas reservoir of regular shape, at the centre of whose internal volume opens one end of a tube, the other end of this tube being provided to supply gas in vapour form to a narrow-opening injector of the burner.

In one preferred embodiment of the invention, the tube and the reservoir form an integral part of the torch, whilst a filling valve of the kind used in gas lighters is provided at the bottom of the reservoir to fill it with predosed refills of liquid gas slightly smaller in volume than the internal volume of the reservoir.

In another preferred embodiment of the invention, the reservoir is in the form of a disposable gas cartridge designed to be accommodated in the body of the torch. Internally this cartridge comprises the aforementioned gas inlet tube which opens at the centre of the internal volume of the cartridge. This cartridge is predosed with a quantity of liquid gas slightly smaller than half the internal volume of the cartridge.

In the two embodiments of the invention described above, the self-contained torch can be positioned in any direction, the open end of the gas inlet tube always opening into a space of the reservoir which only contains gas in vapour form.

It has been found that the position of the gas inlet tube opening at the centre of the liquid gas reservoir does not completely eliminate the danger of blockage of the narrow-opening injector by gas in liquid form, because when the torch is in operation gas can be condensed in liquid form over the entire length of the tube to form a drop which collects at the free end of the tube in the reservoir when the torch remains in a position approaching the vertical for any prolonged period.

The self-contained torch according to the invention advantageously comprises a gas inlet tube whose shape is sufficient to prevent the accumulation of a drop of condensed liquid gas at its free end, thereby eliminating the disadvantage referred to above.

The torch according to the invention comprises a gas inlet tube provided with a curved free end so that, in the vertical position, any condensation of gas along this inlet tube is reflected in the formation of a drop which collects in the lower bend of the tube before joining the liquid in the reservoir. In the opposite position, the condensation capable of forming a droplet which in turn is capable of blocking the inlet tube is the condensation which forms in the curved part only of that tube, thus limiting the risks of such a blockage.

Two embodiments of the self-contained torch according to the invention are described by way of example in the following with reference to the accompanying drawings, wherein.

Figure 1:
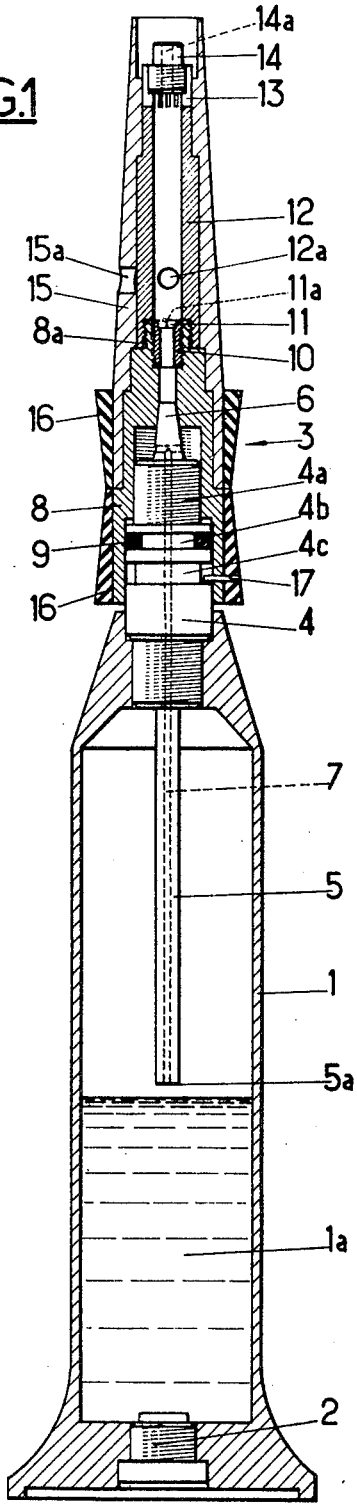
FIG. 1 is a section through one embodiment of a self-contained torch according to the invention in the vertical position.

The reference 1 denotes the body of a substantially cylindrical reservoir widened downwards to facilitate holding. A filling valve 2 similar to that normally provided at the bottom of gas lighters is screwed into the lower end of the reservoir 1.

A burner 3 is fixed to the upper, opposite end of the reservoir 1 through a generally cylindrical supporting element 4.

A gas inlet tube 5 is integral with the lower end of the burner support 4. The opening 5*a* of the tube 5 is situated approximately at the geometric centre of the internal volume of the reservoir 1.

At the upper end of the burner support 4 there is a needle 6. A gas inlet bore 7 extends through the needle 6, the burner support 4 and the gas inlet tube 5.

A gas regulating collar 8 cooperates with the end of the needle 6 by screwing onto a threaded end 4*a* of the burner support 4.

A seal 9 fitted between the gas regulating collar 8 and the burner support 4 prevents gas from escaping at the threaded end 4*a*.

At its upper end, the gas regulating collar 8 comprises an injector block 10 comprising an injector plate 11 formed with an opening 11*a* ranging from 1 to 10 hundredths of a millimeter in size.

A cylindrical mixing chamber 12 is screwed onto the upper end 8*a* of the gas regulating collar 8 and comprises one or more air inlet openings 12*a*.

The upper end of the mixing chamber 12 comprises lateral slots 13, whilst a nozzle 14 screwed to the end of the mixing chamber 12 comprises a central opening 14*a*.

An air regulating collar 15 is fitted with slight clearance so that it can be rotated about the assembly formed by the gas regulating collar 8 and the mixing chamber 12. This air regulating collar 15 comprises openings 15*a* corresponding to the openings 12*a* enabling the intake of air to be regulated through the play in their relative positions. Wheels 16 are force-fitted or cemented onto the gas regulating collar 8 and the air regulating collar 15.

A pin 17 extends through a wheel 16 and the gas regulating collar 8 and, at one end, projects into an annular space 4*c* in the burner support 4. The pin 17 thus acts as a stroke limiter for the gas regulating collar 8.

The reference 1*a* denotes the maximum quantity of liquid gas to be accommodated in the reservoir 1.

Figure 2:
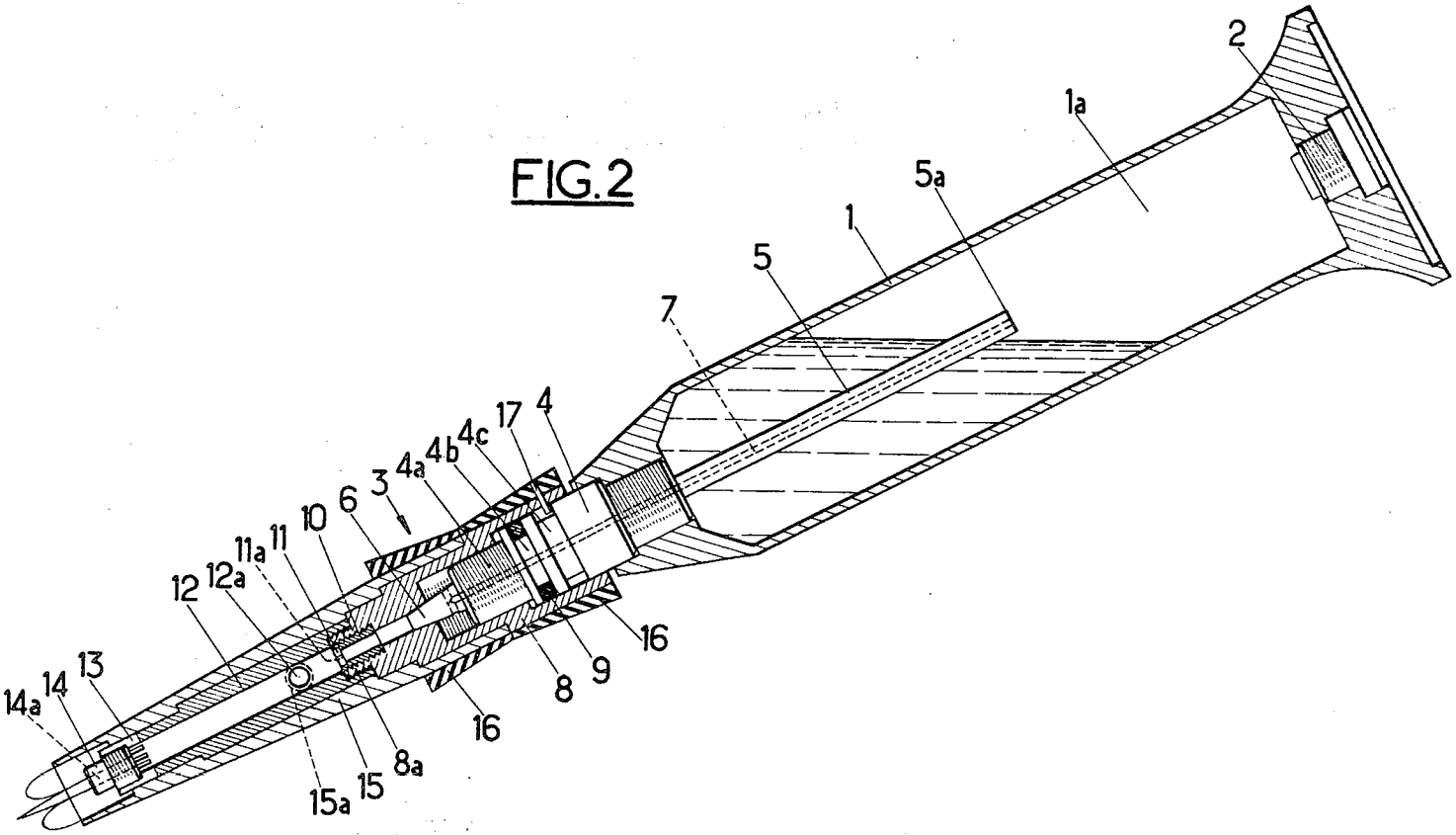
FIG. 2 is a view of the torch shown in FIG. 1 after ignition with the burner directed downwards.

It can be seen from FIGS. 1 and 2 that the free surface of the quantity of liquid gas 1*a* is situated at a certain distance from the opening 5*a* of the gas inlet tube 5. This is always the case irrespective of the position in which the torch is used.

Accordingly, the gas inlet tube 7 can only contain gas in vapour form, and the opening 11*a* of the injector plate 11 is in no danger of blocking the flow of gas in liquid form, even in the initial phase of application.

FIG. 2 shows for example the ignited torch whose downwardly directed flame is made up of a small inner flame 18 issuing from the nozzle 14, and of an annular outer flame 19 produced by the lateral slots 13.

Figure 3:
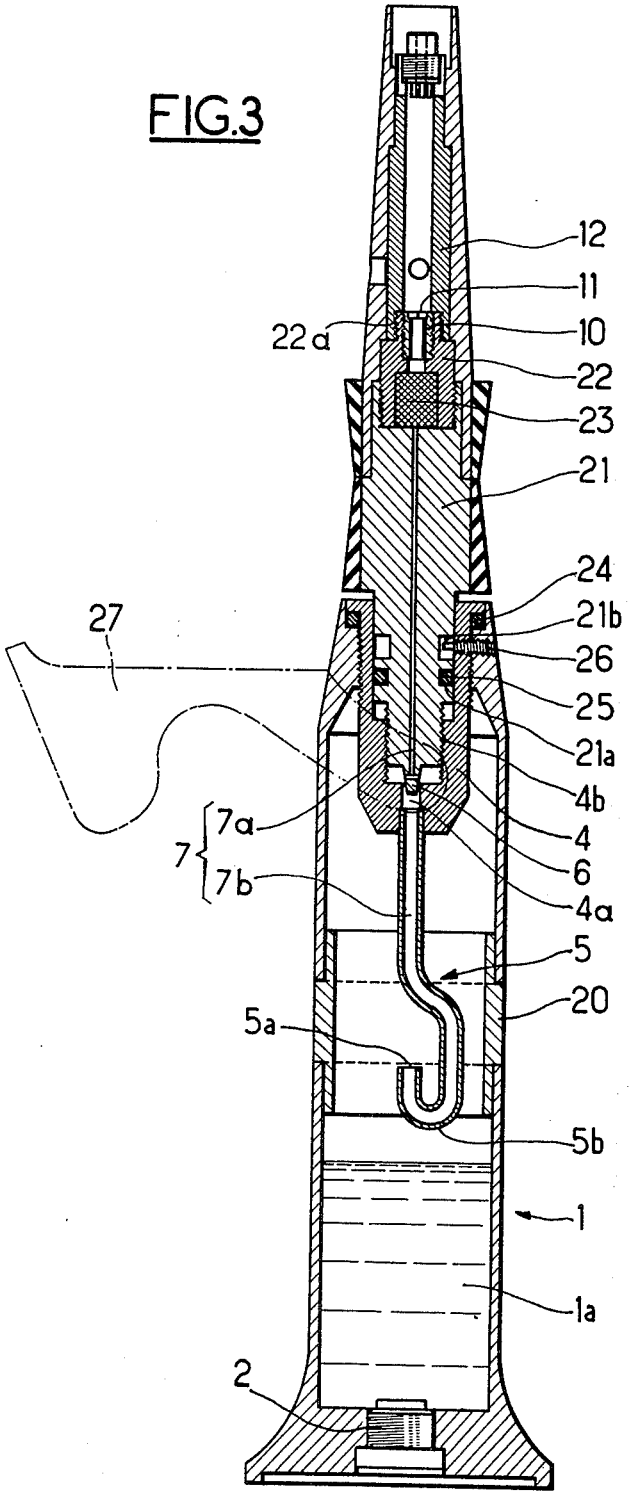
FIG. 3 is a section through a second embodiment of a self-contained torch according to the invention in the vertical position.

Identical references have been used for denoting equivalent components of the torch illustrated in FIGS. 1 and 2 and of the torch shown in FIG. 3.

The reference 1 always denotes a reservoir containing liquid gas 1*a*, in this case in a quantity slightly smaller than the maximum possible quantity. The reservoir 1 comprises an annular window 20 made of a transparent material and situated substantially halfway along the reservoir 1 to enable the filling level of the reservoir to be visually monitored.

In this case, the support 4 comprises a needle seat 4*a* designed to cooperate with the needle 6 which, in this case, is in the opposite position and is supported by a gas regulating sleeve 21 cooperating with a screwthread 4*b* on the aforementioned support 4. The gas regulating sleeve 21 also comprises an upper part 7*a* of the gas inlet bore 7.

The gas inlet tube 5 comprises the lower end 7*b* of the gas inlet bore 7. In addition, the gas inlet tube 5 comprises a bend 5*b*, the opening 5*a* of the gas inlet tube 5 always opening substantially at the centre of the inner volume of the reservoir 1.

The injector block 10 comprising the injector plate 11 is screwed into a nipple 22 which itself is screwed to the upper part of the gas regulating sleeve 21 so as to position a felt 23. The felt 23 is then situated in an intermediate position between the injector plate 11 and the inverted needle 6. The mixing chamber 12 is screwed at 22*a* to the upper end of the nipple 22.

The references 24 and 25 denote two sealing rings positioned respectively between the reservoir 1 and the support 4 and between the support 4 and the gas regulating sleeve 21, a first annular groove 21*a* being provided for positioning the seal 25.

In this embodiment, a screw 26 extending through the reservoir 1 and the support 4 in fluidtight manner acts as stroke limiter for the gas regulating sleeve 21 which, to this end, comprises a second annular groove 21*b*.

The reference 27 denotes a stand shown in chain-dot lines which is mounted to pivot about the reservoir 1 by means of two diametrically opposite pivot pins (not shown). This stand 27 enables the torch to be kept in a stable position in cases where, for example, it is desired locally to heat a well-defined area or in cases where it is more convenient to offer the article to be heated to the flame, rather than heating this article by holding the torch in the hand. The handle 27 which, in the drawing, is shown in its working position may be pivoted and retracted onto the reservoir 1 to limit the overall dimensions of the torch.

The self-contained torch according to the invention operates as follows: the gas accommodated in the reservoir 1 escapes through the gas inlet bore 7, passing through the bend 5*b* whose end 5*a* opens substantially at the centre of the internal volume of the reservoir 1. Accordingly, any droplets formed by condensation collect in this bend 5*b* only, thus preventing blockage of the gas inlet bore 7.

The gas flowing through this inlet bore 7 is measured by turning the regulating sleeve 21 which cooperates with a screwthread 4*b* formed on the support 4, the travel of this sleeve being limited by a screw 26 engaging in an annular groove 21*b*. By unscrewing the sleeve 21, a larger quantity of gas is able to flow between the needle 6 and its seat 4, thus enabling the size of the inner frame which it is desired to obtain at the outlet end of the torch to be adjusted with precision. Before reaching the end of the torch, the gas is filtered by passing through a felt 23 arranged between the injection plate 11 and the inverted needle 6.

An annular window 21 made of a transparent material and situated substantially halfway along the reservoir 1 enables the level of gas inside the reservoir to be visually monitored.

It is possible in particular to render the gas inlet tube 5 integral with the reservoir 1, and even to provide a reservoir separable from the rest of the torch. A reservoir of this kind may be designed for disposal after use.

It is thus possible, in addition to the annular window 20 provided, to use a metering valve system to limit the quantity of liquid gas introduced into the reservoir 1 during its filling.

I claim:

1. In a self-contained, gas-fired, hand torch comprising a reservoir for liquefied gas and a burner fitted with an air intake adjustment and a gas intake adjustment, the improvement according to which said torch comprises a gas inlet tube leading from said reservoir toward said burner with the reservoir end of said tube located substantially at the center of volume of the gas reservoir so that no liquefied gas will contact said reservoir end of said tube so long as said reservoir is less than half full of said liquefied gas.

2. A self-contained gas torch as claimed in claim 1, in which the gas inlet tube and the reservoir form a single integral part of the torch, and comprising a filling valve for filling the reservoir with predosed refills of liquefied gas slightly smaller in volume than half the internal volume of the reservoir.

3. A self-contained gas torch as claimed in claim 1, in which the reservoir is in the form of a disposable gas cartridge adapted to be received in the body of the torch, said cartridge enclosing a quantity of liquefied gas having a volume slightly less than half the internal volume of the cartridge.

4. A self-contained gas torch as claimed in claim 1, in which the gas inlet tube has a reverse bend at its reservoir end.

5. A self-contained gas torch as claimed in claim 4, in which said tube communicates with said burner through an inverted needle, a felt member, and an injection plate successively.

6. A self-contained gas torch as claimed in claim 1, in which the reservoir has an annular window made of a transparent material and situated substantially halfway along the reservoir to enable the level of the liquefied gas in the reservoir to be visually monitored.

7. A self-contained gas torch as claimed in claim 1, which comprises a stand pivotally attached to the exterior of said reservoir and retractable to nest against said reservoir.

* * * * *